US007113067B2

(12) United States Patent
Hirai et al.

(10) Patent No.: US 7,113,067 B2
(45) Date of Patent: Sep. 26, 2006

(54) WIRE-WOUND COIL AND METHOD FOR MANUFACTURING THE SAME

(75) Inventors: Shinya Hirai, Ishikawa-ken (JP); Yoshio Hanato, Machida (JP); Koki Sasaki, Fukui (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 11/094,558

(22) Filed: Mar. 30, 2005

(65) Prior Publication Data

US 2005/0237141 A1 Oct. 27, 2005

(30) Foreign Application Priority Data

Apr. 21, 2004 (JP) ..... 2004-125950

(51) Int. Cl.
*H01F 27/29* (2006.01)

(52) U.S. Cl. ..... 336/192; 336/83

(58) Field of Classification Search ..... 336/65, 336/83, 192, 198, 200, 232
See application file for complete search history.

(56) References Cited

U.S. PATENT DOCUMENTS 6,242,996 B1 * 6/2001 Sato et al. ..... 336/200
6,472,969 B1 * 10/2002 Hanato ..... 336/192
6,778,055 B1 * 8/2004 Wang ..... 336/83
6,965,289 B1 * 11/2005 Toi et al. ..... 336/83

FOREIGN PATENT DOCUMENTS

| | | |
|---|---|---|
| JP | 2002-170717 | 6/2002 |
| JP | 2002-329618 | 11/2002 |
| JP | 2003-151837 | 5/2003 |
| JP | 2003-243221 | 8/2003 |

* cited by examiner

*Primary Examiner*—Tuyen T Nguyen
(74) *Attorney, Agent, or Firm*—Keating & Bennett, LLP

(57) ABSTRACT

A wire-wound coil includes a core, electrodes, and a wire. The core includes a winding core for winding the wire and a pair of flanges. A depression is formed on the inner lower portion of each of the flanges. The depression has a curved surface that curves inward in a direction from the inner wall to the outer wall of the flange and smoothly connects with the peripheral wall of the winding core. The end portions of the wire are extended along the curved surfaces and the tips of the end portions are bonded to the electrodes. The end portions are in an unstressed state and prevent the generation of tension caused by the contraction of a coating agent.

5 Claims, 20 Drawing Sheets

WIRE-WOUND COIL AND METHOD FOR MANUFACTURING THE SAME

BACKGROUND OF THE INVENTION

1. Field of the Invention

The present invention relates to a wire-wound coil including a wire that is wound around a winding core with wire ends connected to electrodes provided on flanges and to a method for manufacturing the wire-wound coil.

2. Description of the Related Art

FIG. 16 is a perspective view of a known wire-wound coil. FIG. 17 is a side view of a known wire-wound coil in which the coating agent has entered and accumulated in rounded corners R.

As illustrated in FIG. 16, the wire-wound coil includes a core 100 having a winding core 102 around which a wire 101 is wound and flanges 103. The ends of the wire 101 are connected to electrodes 104 provided on peripheral walls of the flanges 103. A portion is removed from each of the flanges 103 to form rounded corners R 103*a*.

In the above-described core 100, a space is created between the end portion 101*a* of the wire 101 and the rounded corner R 103*a* of the flange 103, and a coating agent C used for coating the wire-wound coil accumulates in this space, as illustrated in FIG. 17A. If the coating agent C accumulated in this space contracts due to a temperature change, end portions 101*a* of the wire 101 are pulled towards the surface of the flanges 103 by the contracted coating agent C, as described in FIG. 17B. This may cause the wire 101 to break. Similarly, the wire 101 may break because of expansion of the coating agent C.

A known wire-wound coil that prevents the wire 101 from breaking due to contraction and expansion of the coating agent C by inhibiting the entry and accumulation of the coating agent C into the area around the end portions 101*a* of the wire 101 is disclosed in Japanese Unexamined Patent Application Publication No. 2003-151837.

FIG. 18 is a side view of a known wire-wound coil having a structure for preventing breakage of the wire. As illustrated in FIG. 18, inclined surfaces 103*b* are provided on the flanges 103 of the core 100 of the known wire-wound coil. The end portions 101*a* of the wire 101 are arranged along the inclined surfaces 103*b* such that the tips are connected to the electrodes 104.

In this manner, the space between the end portion 101*a* and the flanges 103 is eliminated. Consequently, the entry and accumulation of the coating agent C into the area around the end portions 101*a* of the wire 101 is eliminated so as to prevent breakage of the wire 101 due to contraction and expansion of the coating agent C.

Similar wire-wound coils in which the end portions of the wire are disposed along the sidewalls of the flanges to prevent breaking of the wire are disclosed in Japanese Unexamined Patent Application Publication Nos. 2002-329618, 2002-170717, and 2003-243221.

However, the above-described known wire-wound coils have the problems described below.

FIGS. 19A and 19B are side views of a wire-wound coil wherein a coating agent has entered and accumulated between the wire-wound coil and a substrate.

As illustrated in FIG. 19A, a space is created between the lower side of the known wire-wound coil and a substrate 200. Therefore, when the wire-wound coil is coated, the coating agent C tends to enter and accumulate in this space. If the coating agent C accumulates in this space, the end portions 101*a* of the wire 101 are pulled toward the substrate 200 when the coating agent C contracts and, consequently, the end portions 101*a* of the wire 101 break, as illustrated in FIG. 19B.

If the wire-wound coil is a wire-wound coil using two wires, such as a common mode choke coil, the flanges 103 have to be divided such that the two wires can be connected to electrodes 104*a* and 104*b*, as illustrated in FIG. 20. To completely separate the electrodes 104*a* and 104*b*, a groove B is provided between the electrodes 104*a* and 104*b*. End portions 101*a*-1 and 101*a*-2 of the two wires are disposed along inclined surfaces 103*b*-1 and 103*b*-2, respectively, and connected to the electrodes 104*a* and 104*b*, respectively. For this wire-wound coil, the coating agent C may enter and accumulate in the groove B and cause the end portions 101*a*-1 and 101*a*-2 to break when contraction or expansion of the coating agent C occurs.

This problem cannot be solved even when a wire-wound coil according to Japanese Unexamined Patent Application Publication Nos. 2002-329618, 2002-170717, and 2003-243221 is used.

SUMMARY OF THE INVENTION

To overcome the problems described above, preferred embodiments of the present invention provide a wire-wound coil that is capable of preventing the breaking of end portions of wire caused by contraction or expansion of a coating agent, and also provide a method for manufacturing the same.

A wire-wound coil according to a first preferred embodiment of the present invention includes a core including a winding core and a pair of flanges provided at the axial ends of the winding core, electrodes provided on the peripheral walls of the flanges, and a wire, which includes end portions that are extended and bonded to the electrodes, wound around the winding core. Curved surfaces that curve inwards in directions from the inner walls to the outer walls of the flanges smoothly connect with the peripheral wall of the winding core so as to form depressions on the flanges. The end portions of the wire are disposed along the curved surfaces of the depressions and the tips of the wires are bonded to the electrodes.

According to this unique structure, by soldering the electrodes, to which the tips of the wire are bonded, to lands of a circuit substrate, the wire-wound coil is attached to the circuit substrate. If the wire-wound coil is coated by a coating agent, the coating agent might enter and accumulate between the end portions and the inner walls of the flanges. However, since the end portions of the wire-wound coil are disposed along the curved surfaces, no space is created between the end portions and the inner walls of the flanges, in other words, between the end portions and the curved surfaces. Consequently, the coating agent neither enters nor accumulates between the end portions of the wire and the curved surfaces.

If another coating agent accumulates between the wire-wound coil and the circuit substrate, the end portions of the wire are pulled when the coating agent contracts. However, since the end portions are in unstressed states in which they curve inwards in directions from the inner walls to the outer walls of the flanges, tension is not generated at the end portions and the end portions do not bear a load even when the end portions are pulled due to contraction of the coating agent.

According to a second preferred embodiment of the present invention, in the wire-wound coil according to the first preferred embodiment of the present invention, the cross-section of each of the curved surfaces of the depressions is preferably substantially arc-shaped.

The wire-wound coil according to a third preferred embodiment of the present invention includes a core including a winding core and a pair of flanges provided at the axial ends of the winding core, a pair of bases, the upward direction of each of which is substantially perpendicular to the axial direction of the winding core, on each of the flanges, electrodes provided on the tips of the bases, and first and second wires wound around the winding core. The end portions of the first wire are extended and bonded to one of the electrodes of each of the flanges, and the end portions of the second wire are extended and bonded to the other electrode of each of the flanges. Curved surfaces that curve inward in directions from the inner walls to the outer walls of the flanges smoothly connect with the peripheral wall of the winding core so as to form depressions. The end portions of the first wire are disposed along the curved surfaces of the depressions provided on one of the bases of each of the flanges, and the tips of the first wire are bonded to the electrodes on the bases. The end portions of the second wire are disposed along the curved surfaces of the depressions provided on the other of the bases of each of the flanges such that the end portions of the second wire do not extend into grooves formed between the two pairs of bases, and the tips of second wire are bonded to the electrodes on the bases.

According to this unique structure, by soldering the electrodes, to which the tips of the first and second wires are bonded, to lands of a circuit substrate, the wire-wound coil is attached to the substrate. If the wire-wound coil is coated by a coating agent, the coating agent might enter and accumulate between the end portions of the first and second wires and the inner walls of the flanges. However, since the end portions of the wire-wound coil are disposed along the curved surfaces, no space exists between the end portions of the first and second wires and the inner walls of the flanges, in other words, between the end portions and the curved surfaces. Consequently, the coating agent neither enters nor accumulates between the end portions and the curved surfaces.

If another coating agent accumulates between the wire-wound coil and the circuit substrate, the end portions of the wire are pulled when the coating agent contracts. However, since the end portions are in unstressed states in which they curve inwards in directions from the inner walls to the outer walls of the flanges, no tension is generated at the end portions and the end portions do not bear a load even when the end portions are pulled due to contraction of the coating agent. If the end portions of the second wire span grooves between the two pairs of bases when the coating agent accumulates between the two pairs of bases, the end portions will be pulled or pushed due to contraction or expansion of the coating agent. However, for the wire-wound coil according to the third preferred embodiment of the present invention, the end portions of the second wire are disposed along the curved surfaces of the depressions of the bases so as not to extend into the groove. Therefore, even if the coating agent accumulates in the grooves, the end portions are not pulled or pushed due to the contraction or expansion of the coating agent.

According to a fourth preferred of the present invention, in the wire-wound coil according to the third preferred embodiment of the present invention, the cross-section of each of the curved surfaces of the depressions is preferably substantially arc-shaped.

A method for manufacturing a wire-wound coil according to a fifth preferred embodiment of the present invention includes a core-forming step, an electrode-forming step, a winding step, and a wire-bonding step. In the core-forming step, a core including a winding core and a pair of flanges provided at the axial end portions of the winding core is formed. In the electrode-forming step, electrodes are formed on the peripheral walls of the flanges of the core. In the winding step, a wire is wound around the winding core while the core is held. In the wire-bonding step, the tips of the wire wound around the wire core are extended and bonded to the electrodes. The core-forming step includes a process of forming curved surfaces that curve inwards in directions from the inner walls to the outer walls of the flanges and smoothly connecting with the peripheral wall of the winding core so as to form depressions. The wire-bonding step includes a process of pressing the end portions of the wire with wire rods against the curved surfaces of the depressions while the wire rods are moved along the curved surfaces so as to dispose the end portions of the wire close against the curved surfaces of the depressions.

According to the method for manufacturing a wire-wound coil according to the fifth preferred of the present invention, a core including a winding core and a pair of flanges provided at the axial end portions of the winding core is formed. In the core-forming step, curved surfaces, which curve inwards in directions from the inner walls to the outer walls of the flanges and smoothly connecting with the peripheral wall of the winding core so as to form depressions, are formed. Subsequently, in the electrode-forming step, electrodes are provided on the peripheral walls of the flanges of the core. In the winding step, a wire is wound around the winding core while the core is held. In the wire-bonding step, the tips of the wire wound around the wire core are extended and bonded to the electrodes. At this time, the end portions of the wire are pressed against the curved surfaces of the depressions with wire rods while the wire rods are moved along the curved surfaces so as to position the end portions of the wire close against the curved surfaces of the depressions.

According to a sixth preferred embodiment of the present invention, in the method for manufacturing a wire-wound coil according to the fifth preferred embodiment of the present invention, the cross-section of each of the curved surfaces of the depressions is preferably substantially arc-shaped.

A method for manufacturing a wire-wound coil according to a seventh preferred embodiment of the present invention includes a core-forming step, an electrode-forming step, a winding step, and a wire-bonding step. In the core-forming step, a core including a winding core, a pair of flanges provided at the axial end portions of the winding core, and a pair of bases provided on each of the flanges, the pair of bases being substantially perpendicular to the axial direction of the winding core is formed. In the electrode-forming step, electrodes are formed on the tips of the pair of bases. In the winding step, first and second wires are wound around the winding core while the core is held. In the wire-bonding step, the tips of the first and second wires wound around the wire core are extended and bonded to the electrodes on the bases of each of the flanges. The core-forming step includes a process of forming the curved surfaces that curve inwards in directions from the inner walls to the outer walls of the flanges and smoothly being connected with the peripheral wall of the winding core so as to form depressions. The wire-bonding step includes a process of pressing end portions of the first and second wires against the curved surfaces of the depressions with wire rods while the wire rods are moved along the curved surfaces so as to position the end portions of the first and second wires close against the curved surfaces of the depressions.

In the core-forming step, a core including a winding core, a pair of flanges provided at the axial end portions of the winding core, and a pair of bases provided on each of the flanges and being substantially perpendicular to the axial direction of the winding core is formed. The curved surfaces, which curve inward in directions from the inner walls to the outer walls of the flanges and smoothly connect with the peripheral wall of the winding core so as to form depressions, are formed. In the electrode-forming step, electrodes are formed on the tips of the pair of bases. Subsequently, in the winding step, first and second wires are wound around the winding core while the core is held. Finally, in the wire-bonding step, the tips of the first wire wound around the wire core are extended and bonded to the electrode on one of the bases of each of the flanges and the tips of the second wire wound around the wire core are extended and bonded to the electrode on the other of the bases of each of the flanges. At this time, the end portions of the first and second wires are pressed against the curved surfaces of the depressions with wire rods while the wire rods are moved along the curved surfaces so as to dispose the end portions of the first and second wires close against the curved surfaces of the depressions.

According to an eighth preferred embodiment of the present invention, in the method for manufacturing a wire-wound coil according to a seventh preferred embodiment of the present invention, the wire-bonding step includes a process of inserting another wire rod in grooves between each of the pairs of bases and pressing at least one of the end portions of the first and second wires extending across the groove toward the wiring core so as to move the end portions from the grooves towards the peripheral wall of the winding core.

According to this inserting process, the end portions spanning the grooves between the bases are moved towards the peripheral wall side of the winding core away from the grooves. Therefore, even if the coating agent is accumulated in the groove, the end portions are not pulled or pushed due to contraction or expansion of the coating agent.

According to a ninth preferred embodiment of the present invention, in the method for manufacturing a wire-wound coil according to the seventh or eighth preferred embodiment of the present invention, the cross-section of each of the curved surfaces of the depressions is preferably substantially arc-shaped.

As described in detail above, according to the first, second, fifth, and sixth preferred embodiments of the present invention, a space is not created between the end portions of the wire and the inner walls of the flanges, in other words, between the end portions and the curved surfaces since the end portions of the wire-wound coil are disposed along the curved surfaces. Consequently, the coating agent neither enters nor accumulates between the end portions and the curved surfaces, and, thus, the end portions are prevented from breaking due to contraction or expansion of the coating agent.

If a coating agent accumulates between the wire-wound coil and the circuit substrate, since the end portions are in an unstressed state in which they curve inwards in directions from the inner walls to the outer walls of the flanges, no tension is generated at the end portions due to contraction of the coating agent and the end portions do not bear a load even when the end portions are pulled due to contraction of the coating agent. As a result, the end portions do not break due to contraction of the coating agent.

According to the third, fourth, seventh, and ninth preferred embodiments of the present invention, the coating agent does not enter or accumulate between the end portions of the first and second wires and the curved surfaces of the depressions. Therefore, the end portions do not break due to the entering and accumulation of the coating agent. Moreover, even if the end portions are pulled due to contraction of the coating agent accumulated between the wire-wound coil and the circuit substrate, no tension or load is applied to the end portions. Therefore, breakage of the wire due to the coating agent accumulated between the wire-wound coil and the circuit substrate is effectively prevented. Since the end portions of the second wire are disposed along the curved surfaces of the depressions of one of the bases such that they do not extend into the grooves, the end portions do not break due to the coating agent accumulated in the grooves even when the coating agents accumulate in the grooves.

Other features, elements, steps, characteristics and advantages of the present invention will become more apparent from the following detailed description of preferred embodiments with reference to the attached drawings.

DETAILED DESCRIPTION OF PREFERRED EMBODIMENTS

Preferred embodiments of the present invention will be described below with reference to the drawings.

First Preferred Embodiment

Figure 1:
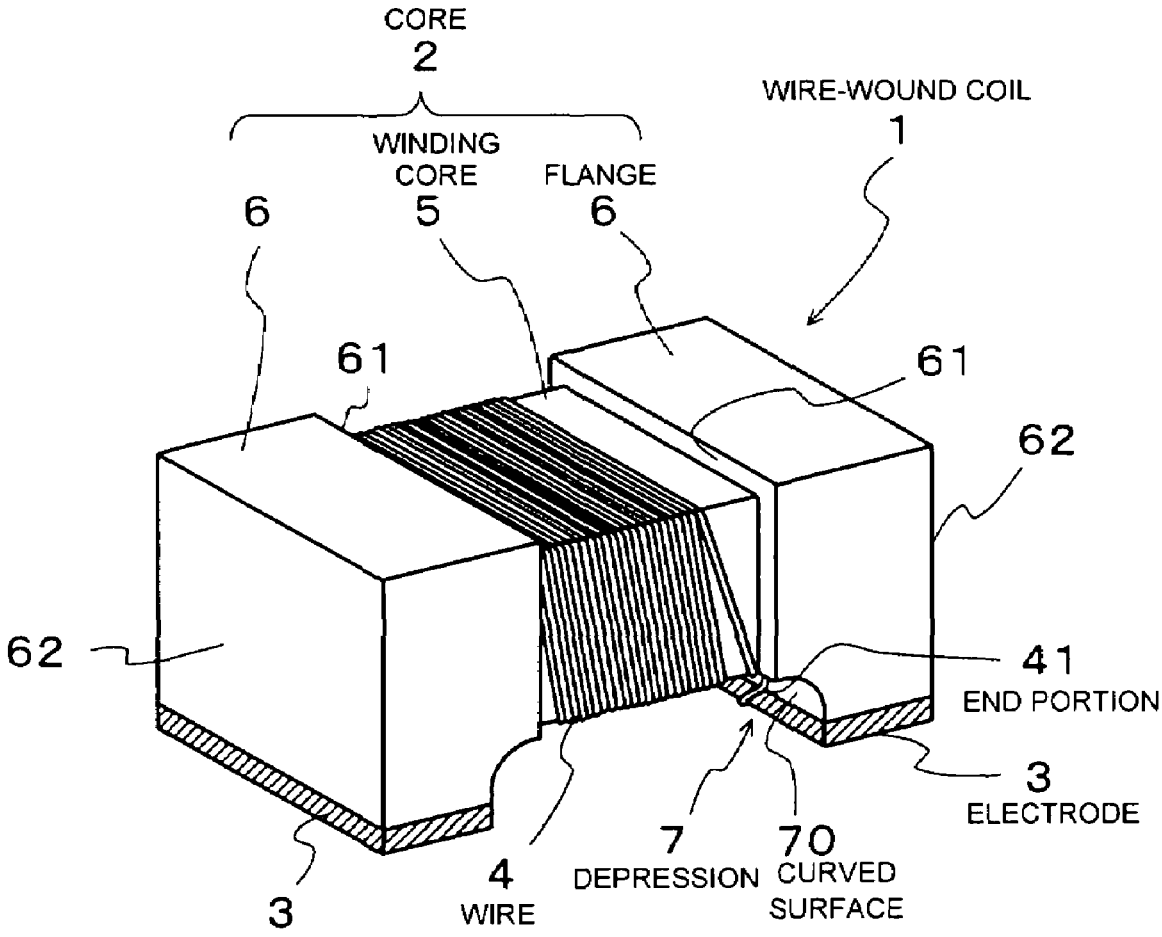
FIG. 1 is a perspective view of a wire-wound coil according to a first preferred embodiment of the present invention.
Figure 2:
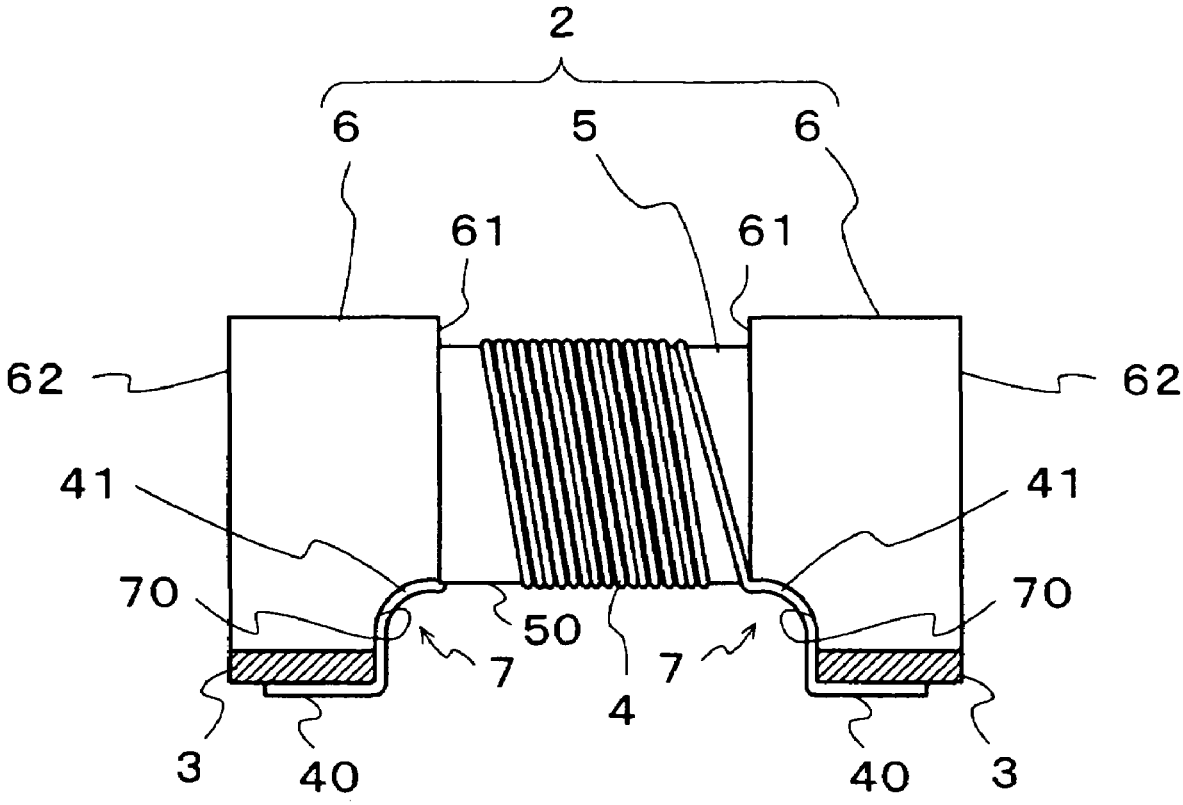
FIG. 2 is a side view of the wire-wound coil.
Figure 3:
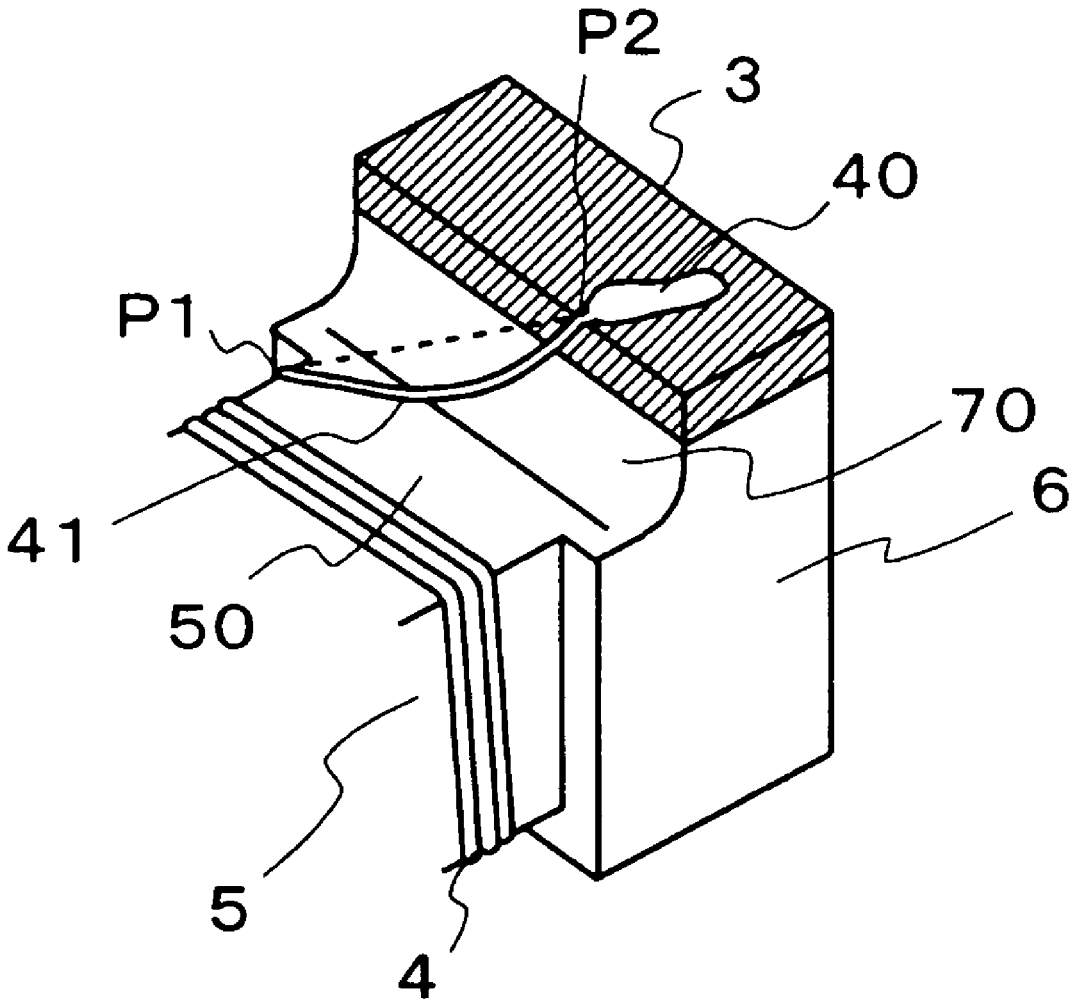
FIG. 3 is an enlarged partial view of a flange of the wire-wound coil viewed from below.

FIG. 1 is a perspective view of a wire-wound coil according to a first preferred embodiment of the present invention, FIG. 2 is a side view of the wire-wound coil, and FIG. 3 is an enlarged partial view of a flange of the wire-wound coil.

As illustrated in FIGS. 1 and 2, a wire-wound coil 1 according to this preferred embodiment includes a core 2, electrodes 3, and a wire 4.

The core 2 is preferably composed of a magnetic material or a nonmagnetic material and includes a prismatic winding core 5 for winding the wire 4 around, and a pair of flanges 6.

Each of the pair of flanges 6 is substantially prism-shaped and is provided at an axial end of the winding core 5 (the left and right ends of the winding core 5 illustrated in FIG. 2). A depression 7 is provided at the inner lower portion of each of the flanges 6.

The depression 7 includes a curved surface 70 that curves inward in a direction from the inner wall 61 to the outer wall 62 of each of the flanges 6. The curved surface 70 smoothly connects with the lower side of a peripheral wall 50 of the winding core 5, as illustrated in FIG. 3, and forms an arc that curves downwards from the peripheral wall 50 towards the electrode 3.

As illustrated in FIG. 1, the electrodes 3 are disposed on the lower surface of the peripheral wall of the flanges 6. The electrodes 3, preferably composed of a nickel (Ni), tin (Sn), or tin-lead (Sn—Pb) plating layer having a thickness of about 1 μm to about 30 μm, for example, are disposed on a silver (Ag), silver-palladium (Ag—Pd), or silver-platinum (Ag—Pt) film having a thickness of about 10 μm to about 30 μm.

The wire 4 is composed of copper (Cu), silver (Ag), or gold (Au) and is coated with insulation. As illustrated in FIG. 2, the wire 4 is wound around the winding core 5 and tips 40 of the wire 4 are connected to the electrodes 3 of the flanges 6.

Figure 4:
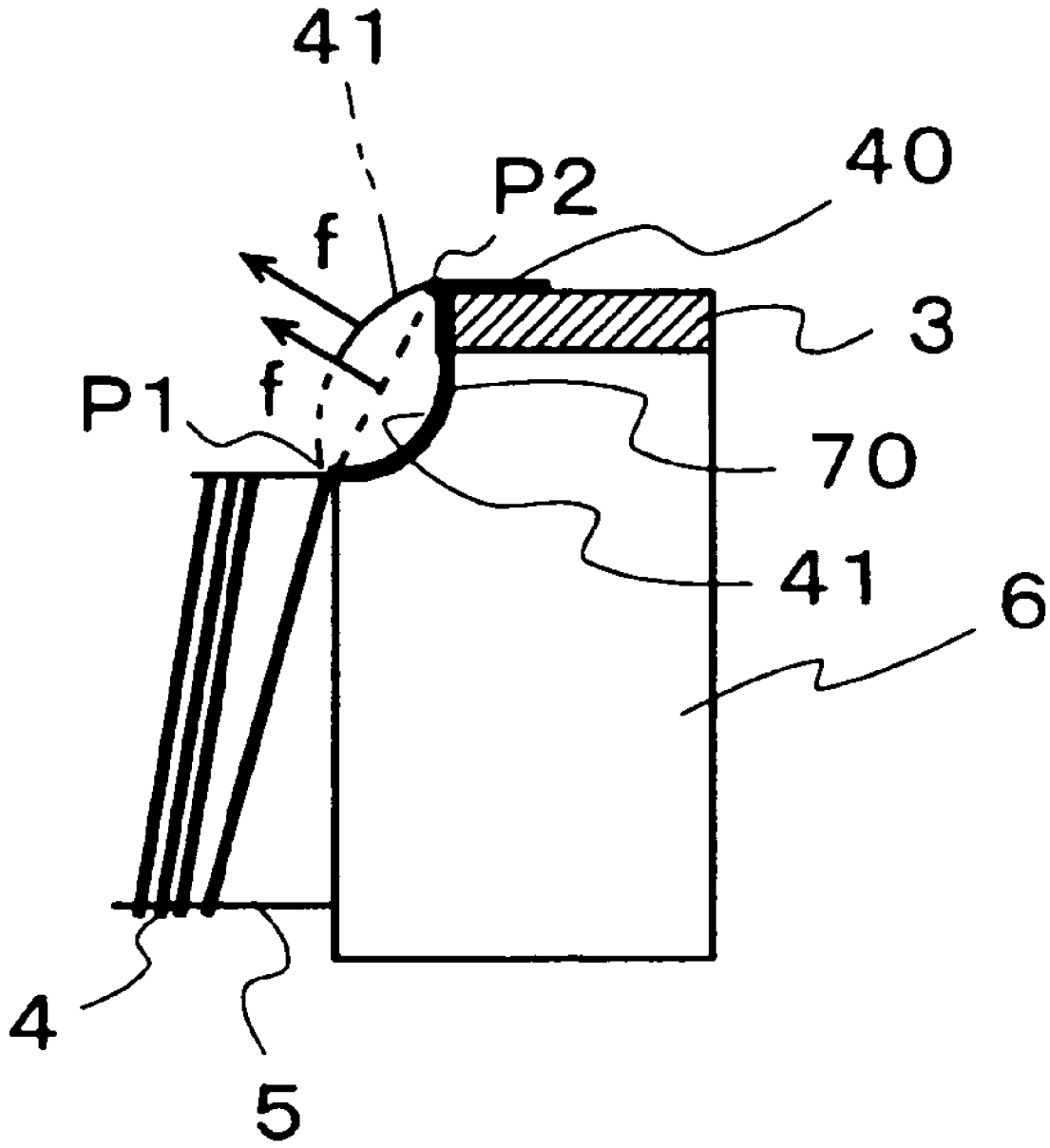
FIG. 4 is a partial side view of the wire-wound coil describing the effect of the end portions of the wire.

More specifically, as illustrated in FIG. 3, an end portion 41 of the wire 4 is disposed along the curved surface 70. The tip 40 of the wire 4 is bonded to the surface of the electrode 3. In this manner, the end portion 41 is longer and sags as compared to if the end portion 41 is disposed in a straight line from origin P1 to end point P2 as illustrated by the dotted line in FIG. 3. Accordingly, as illustrated by the dotted line in FIG. 4, if the end portion 41 is disposed in a straight line from origin P1 to end point P2, tension is generated at the end portion 41 when an external force f is applied in the direction indicated by the arrow. In such a case, there is a high probability that the wire will break. However, according to this preferred embodiment, the end portion 41 sags and, thus, is displaced as indicated by the chain double-dashed line when an external force f is applied. In this manner, unless the end portion 41 is completely stretched outwards as an arc, no tension is generated at the end portion 41, and the end portion 41 does not bear a load.

A method for manufacturing the wire-wound coil 1 according to a preferred embodiment will be described below.

Figure 5:
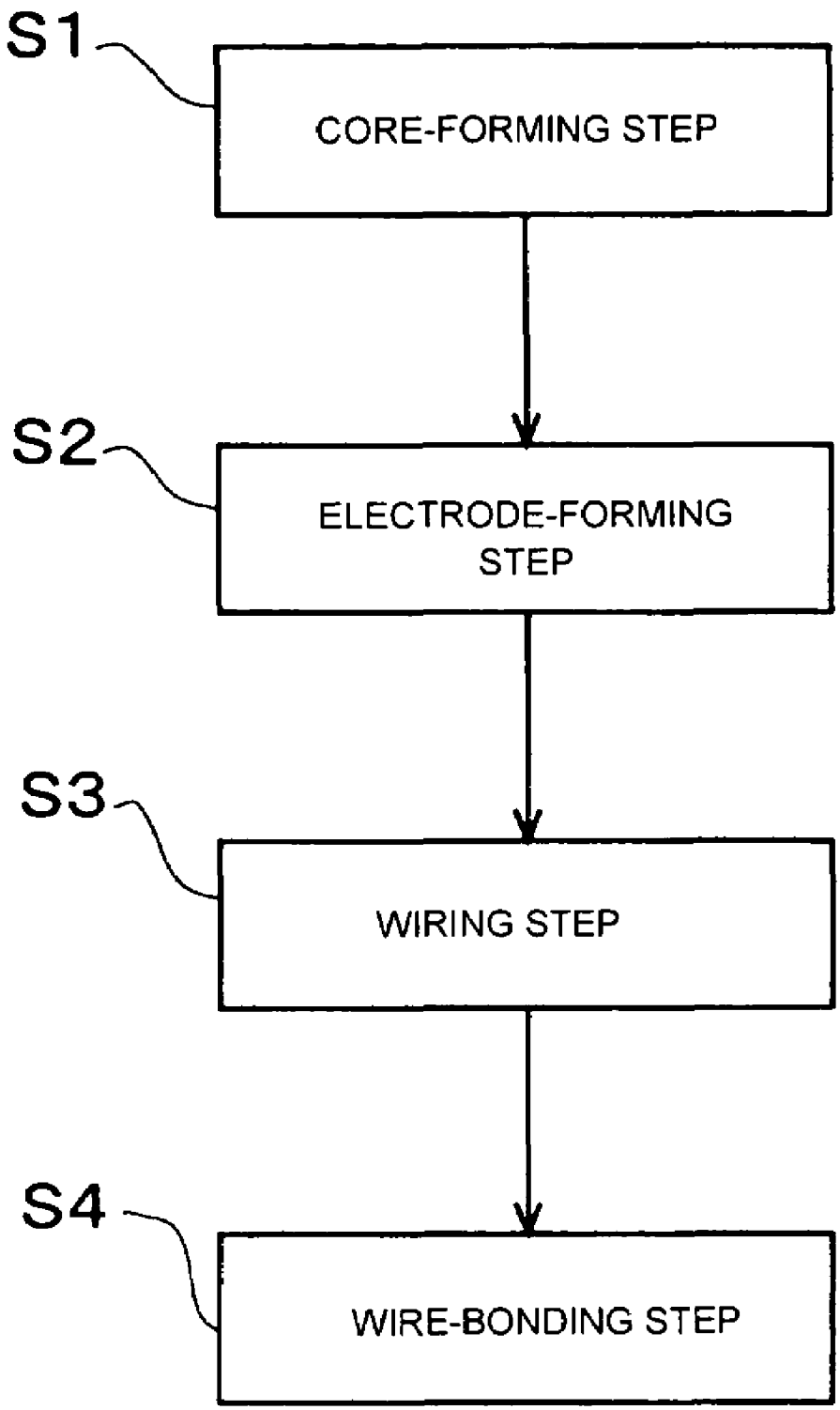
FIG. 5 is a process chart illustrating the manufacturing process of a wire-wound coil according to a preferred embodiment of the present invention.

FIG. 5 is a process chart illustrating the manufacturing process of the wire-wound coil 1 according to the present preferred embodiment. The method to be described below is a practical application of the method for manufacturing a wire-wound coil according to the fifth and sixth preferred embodiments of the present invention.

As illustrated in FIG. 5, the method preferably includes a core-forming step S1, an electrode-forming step S2, a winding step S3, and a wire-bonding step S4.

The first step of the method for manufacturing the wire-wound coil 1 according to this preferred embodiment is the core-forming step S1.

The core-forming step S1 is a step for forming the core 2 of the wire-wound coil 1.

More specifically, the core 2 including the winding core 5 and the pair of flanges 6 (refer to FIGS. 1 and 2) is formed by molding and firing a magnetic body or a non-magnetic body. At this time, the depression 7 including the curved surface 70 is formed on the inner lower portion of each of the flanges 6.

Subsequently, the electrode-forming step S2 is carried out on the core 2 formed in the core-forming step S1.

The electrode-forming step S2 is a step for forming the electrodes 3 on the lower surface of the flanges 6 of the core 2. More specifically, by dipping or printing pastes such as Ag, Ag—Pd, or Ag—Pt paste, for example, onto the lower surface of the flanges 6, a first layer having a thickness of, for example, about 10 μm to about 30 μm is formed on the lower surface of each of the flanges 6. Then, the electrode-forming step S2 is completed by forming a Ni, Sn, or Sn—Pb plating layer having a thickness of, for example, about 1 μm to about 30 μm on the first layer.

Subsequently, the winding step S3 is performed.

Figure 6:
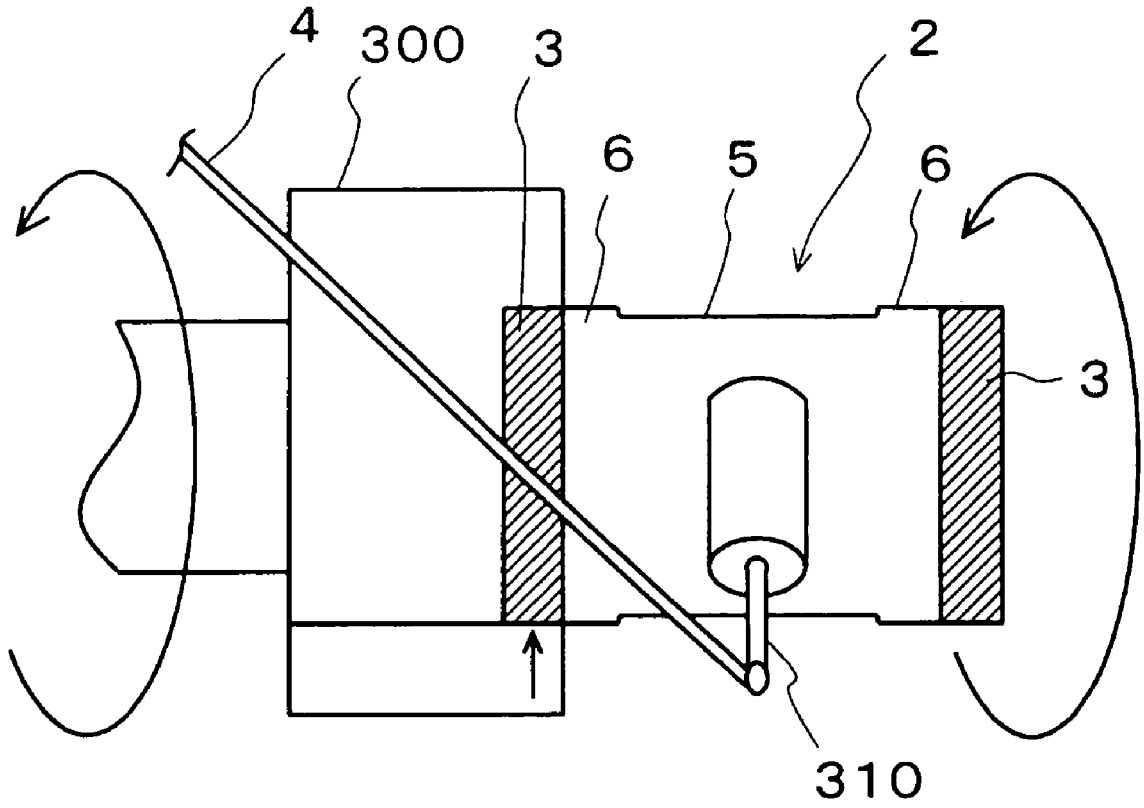
FIG. 6 is a schematic view illustrating the beginning of the wire-winding step.
Figure 7:
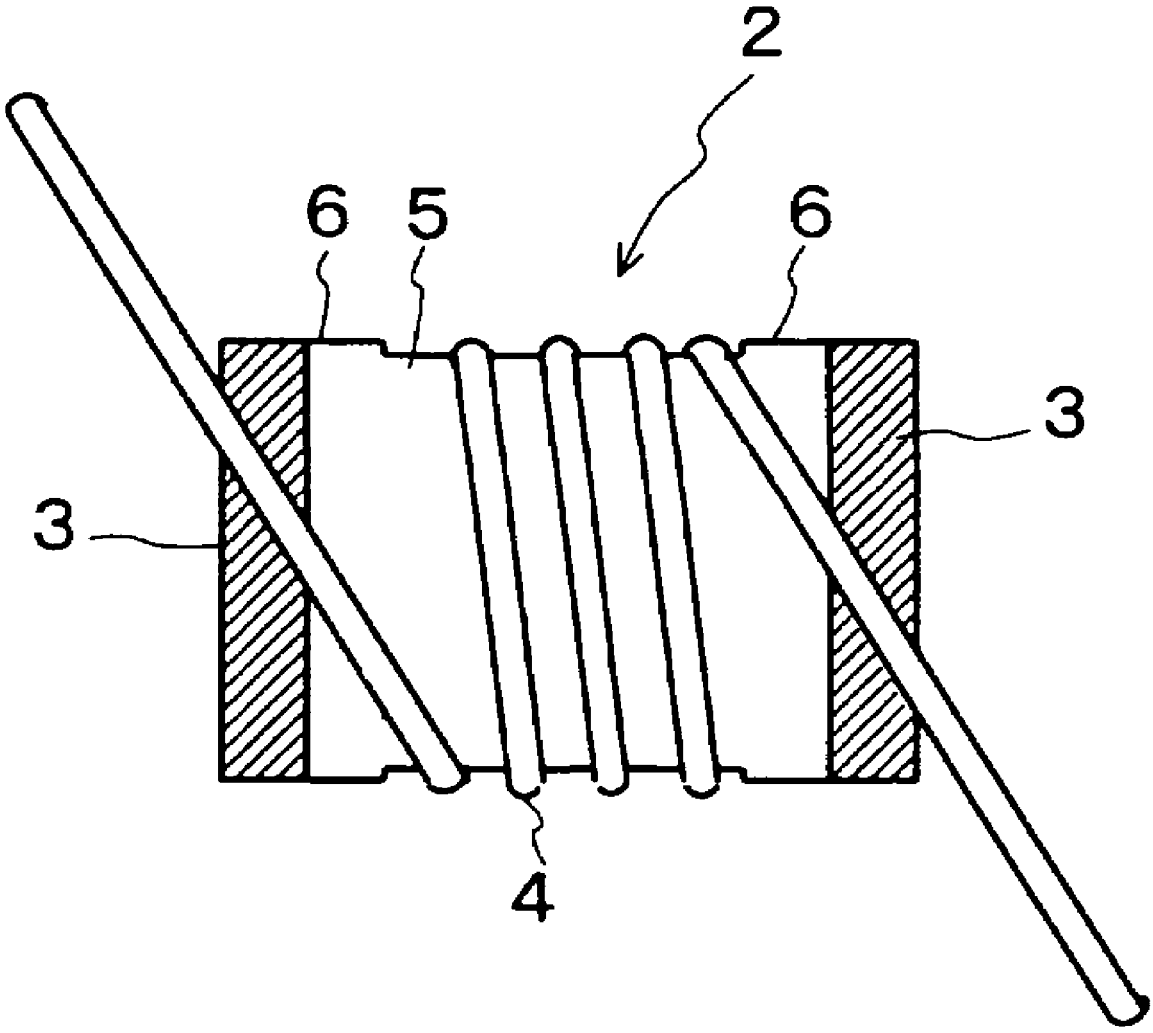
FIG. 7 is a schematic view illustrating the end of the wire-winding step.

FIG. 6 is a schematic view illustrating the beginning of wire-winding in the winding step S3, and FIG. 7 is a schematic view illustrating the end of wire-winding in the winding step S3.

The wire-winding step S3 is a step for winding the wire 4 around the winding core 5 while holding the core 2 with a chuck 300, as illustrated in FIG. 6. More specifically, one of the flanges 6 is held with the chuck 300. Subsequently, the end of the wire 4 sent out from a wire nozzle 310 is fixed on the one of the electrodes 3 (the electrode on the left in FIG. 6). Then, the core 2 is rotated by the chuck 300 in the direction indicated by the arrow so as to wind the wire 4 around the winding core 5 (this is known as the spindle method). After winding the wire 4 a predetermined number of turns around the winding core 5, as illustrated in FIG. 7, the end of the wire 4 is fixed on the other electrode 3 (the right electrode in FIG. 7). In this manner, the wire-winding step S3 is completed.

Finally, the wire-bonding step S4 is performed.

Figure 8:
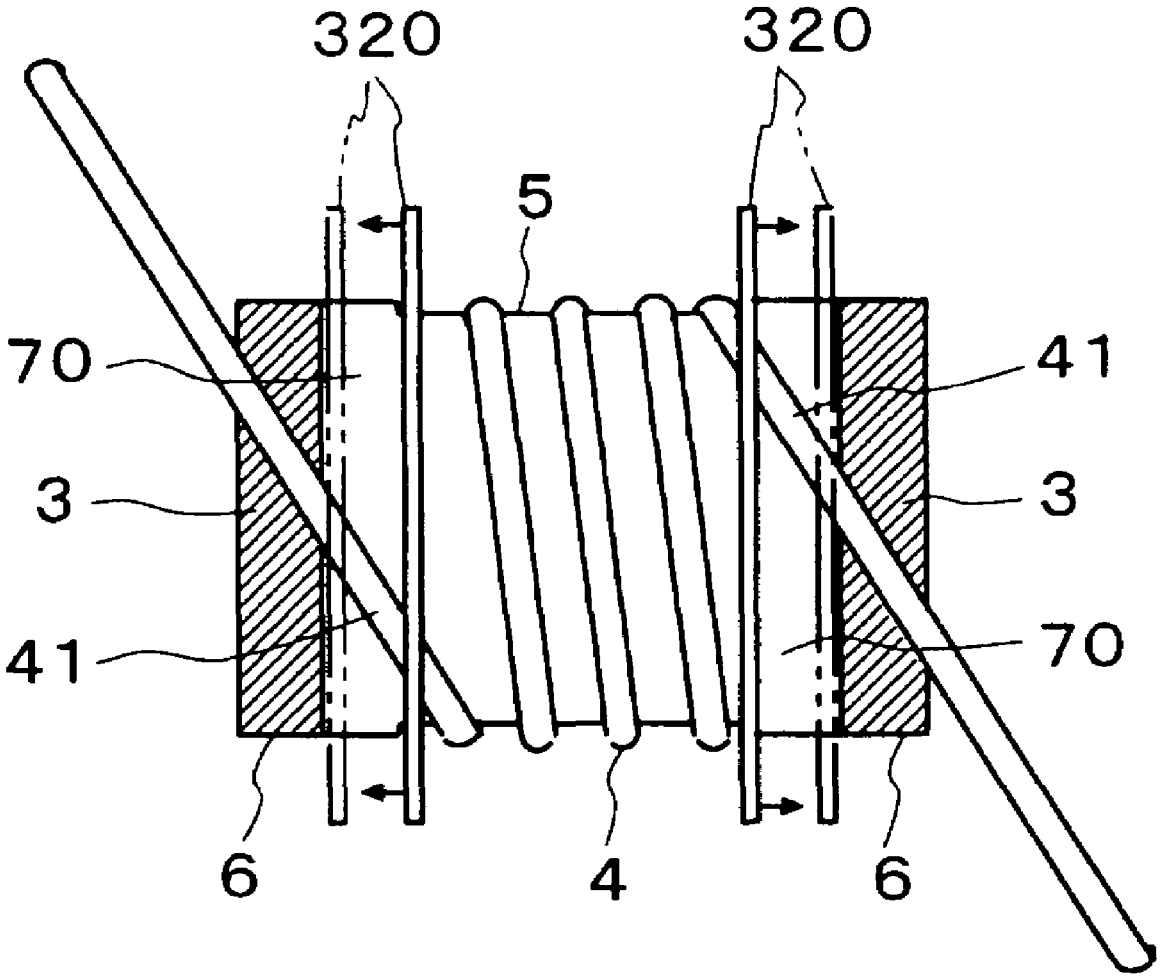
FIG. 8 is a plan view illustrating the process of the end portions of the wire, which is one of processes in the wire-bonding step.
Figure 9:
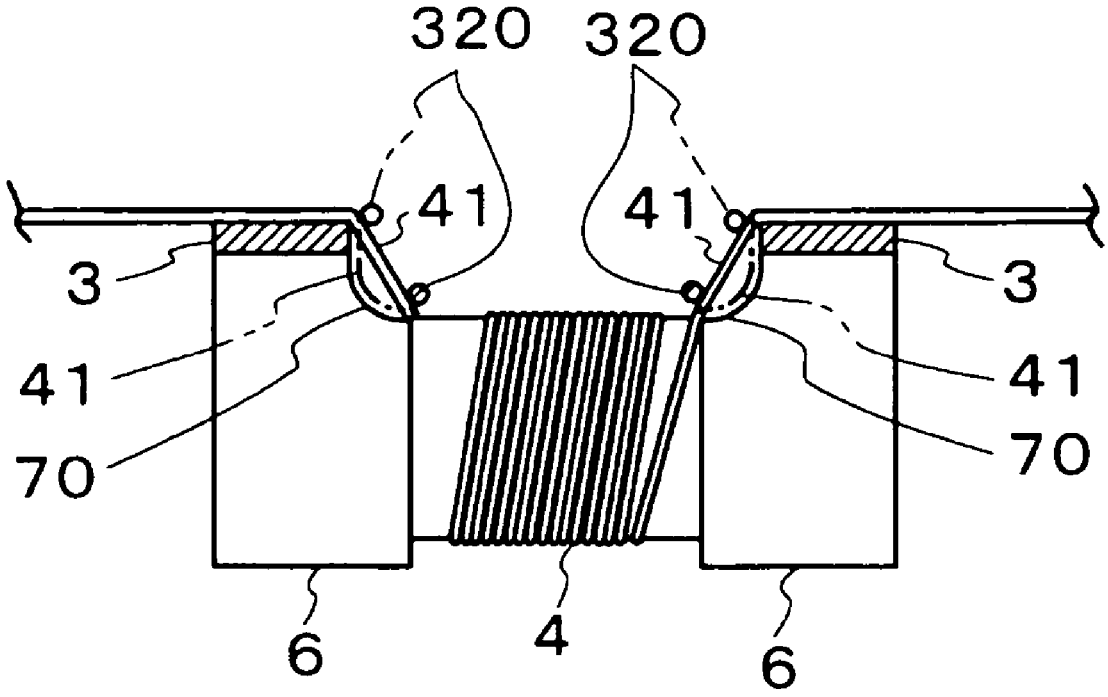
FIG. 9 is a side view illustrating the process of the end portions of the wire.

FIG. 8 is a plan view illustrating the process of the end portions 41 of the wire, which is one of the processes in the wire-bonding step S4. FIG. 9 is a side view illustrating the process of the end portions 41.

The wire-bonding step S4 is a step for bonding the tips 40 of the wire 4 wound around the winding core 5 to the electrodes 3.

More specifically, wire rods 320 are arranged substantially parallel with the curved surfaces 70 and in contact with the end portions 41 of the wire 4, as illustrated in FIGS. 8 and 9. Then, the wire rods 320 are moved upward along the upward direction of the curved surfaces 70, as indicated by the arrows in FIGS. 8 and 9, while the wire rods 320 press the end portions 41 against the curved surfaces 70. In this manner, as illustrated in FIG. 9, the wire 4 extending outward from the electrodes 3 of the core 2 is pulled inwards towards the electrodes 3, and the end portions 41 are curved inwards right against the curved surfaces 70. In order to curve the end portions 41 precisely against the curved surfaces 70, the radius of the wire rods 320 is between about 0.1 and about 1.0 times the radius of curvature of the curved surfaces 70.

After the end portions 41 are curved, the tips 40 of the wire 4 are connected to the electrodes 3. More specifically, the tips 40 are bonded to surface of the electrodes 3 preferably by thermo-compression. In this manner, as illustrated in FIG. 3, the flattened tips 40 are brazed onto the Sn (Ni or Sn—Pb) layers of the electrodes 3, and a reliable connection is achieved.

As described above, after bonding the wire 4 to the electrodes 3, the extra tips 40 are cut off. In this manner, the wire-wound coil 1 can be coated and, thus, a high quality wire-wound coil 1 is provided.

Next, the operation and advantages of the wire-wound coil 1 according to this preferred embodiment will be described.

Figure 10A:
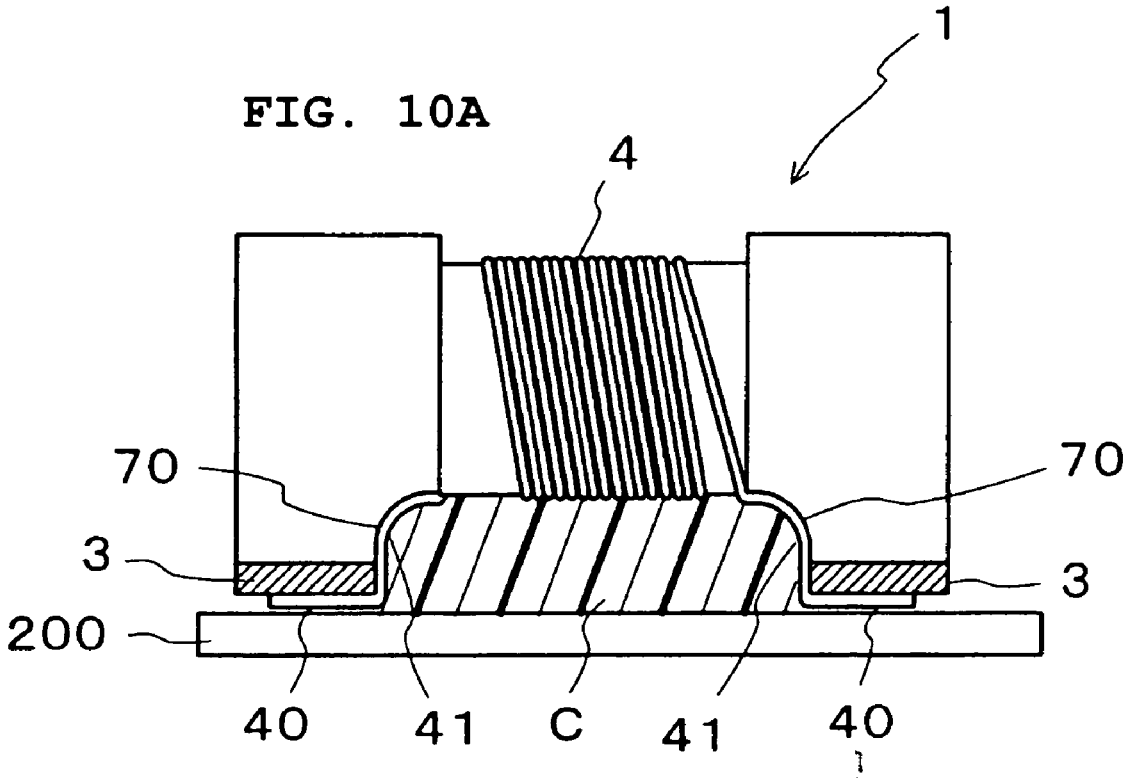
FIGS. 10A and 10B are side views illustrating the effect of preventing the breaking of wire of the wire-wound coil according to a preferred embodiment of the present invention.
Figure 10B:
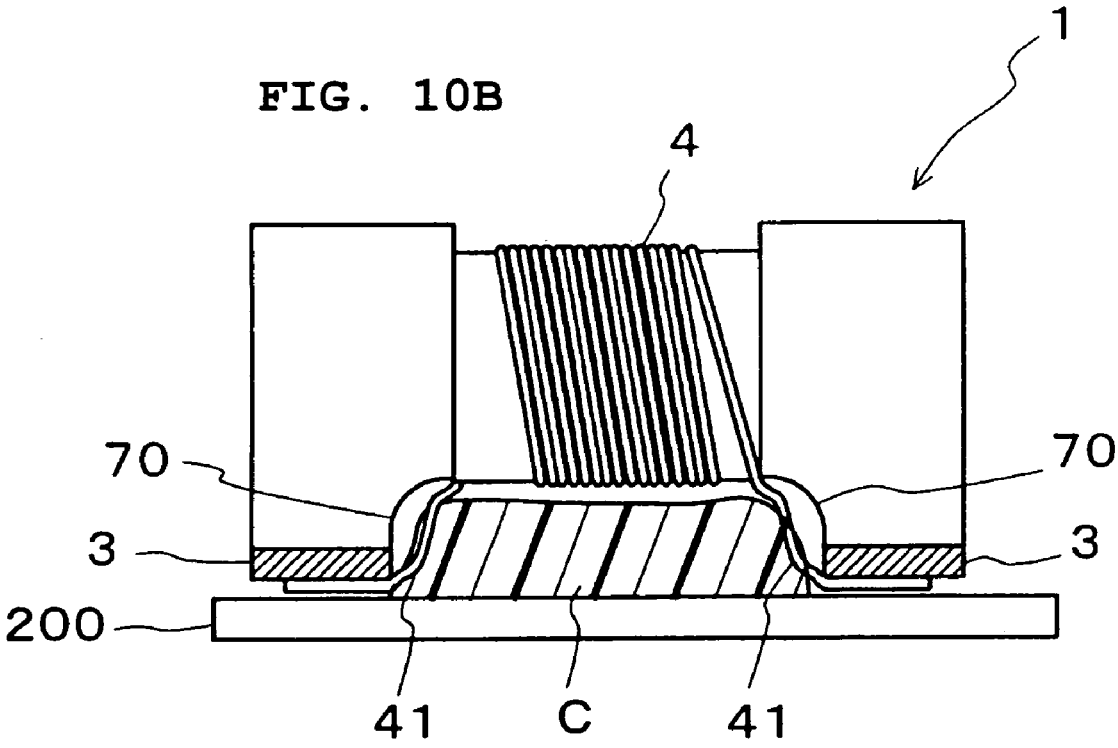

FIGS. 10A and 10B are side views illustrating the effects of preventing the breaking of wire of the wire-wound coil 1.

As illustrated in FIG. 10A, by soldering the electrodes 3 to lands (not shown in the drawings) of the circuit substrate 200, the wire-wound coil 1 is attached to the substrate 200.

If the wire-wound coil 1 is coated by a coating agent, the coating agent C might enter and accumulate between the end portions 41 and the curved surfaces 70 of the depressions 7. However, since the tips 40 of the wire 4 are bonded to the electrodes 3 while the end portions 41 of the wire-wound coil 1 according to this preferred embodiment are disposed along the curved surfaces 70, a substantial space is not created between the end portions 41 and the curved surfaces 70. Consequently, the coating agent C neither enters nor accumulates between the end portions 41 and the curved surfaces 70. As a result, the end portions 41 of the wire 4 are not broken due the coating agent C entering and accumulating between the end portions 41 and the curved surfaces 70.

As illustrated in FIG. 10A, if the coating agent C accumulates between the wire-wound coil 1 and the circuit substrate 200, the end portions 41 of the wire 4 might be pulled by the coating agent C. However, since the end portions 41 of the wire 4 of the wire-wound coil 1 according to this preferred embodiment are disposed along the curved surfaces 70 of the depressions 7, the end portions 41 are in an unstressed state. Therefore, even if the coating agent C contracts, as illustrated in FIG. 10B, the end portions 41 deform along with the contraction of the coating agent C without resistance. Consequently, tension is not generated at the end portions 41, and the end portions 41 do not bear a load. Accordingly, the coating agent C does not break the end portions 41.

Second Preferred Embodiment

Next, a second preferred embodiment of the present invention will be described.

Figure 11:
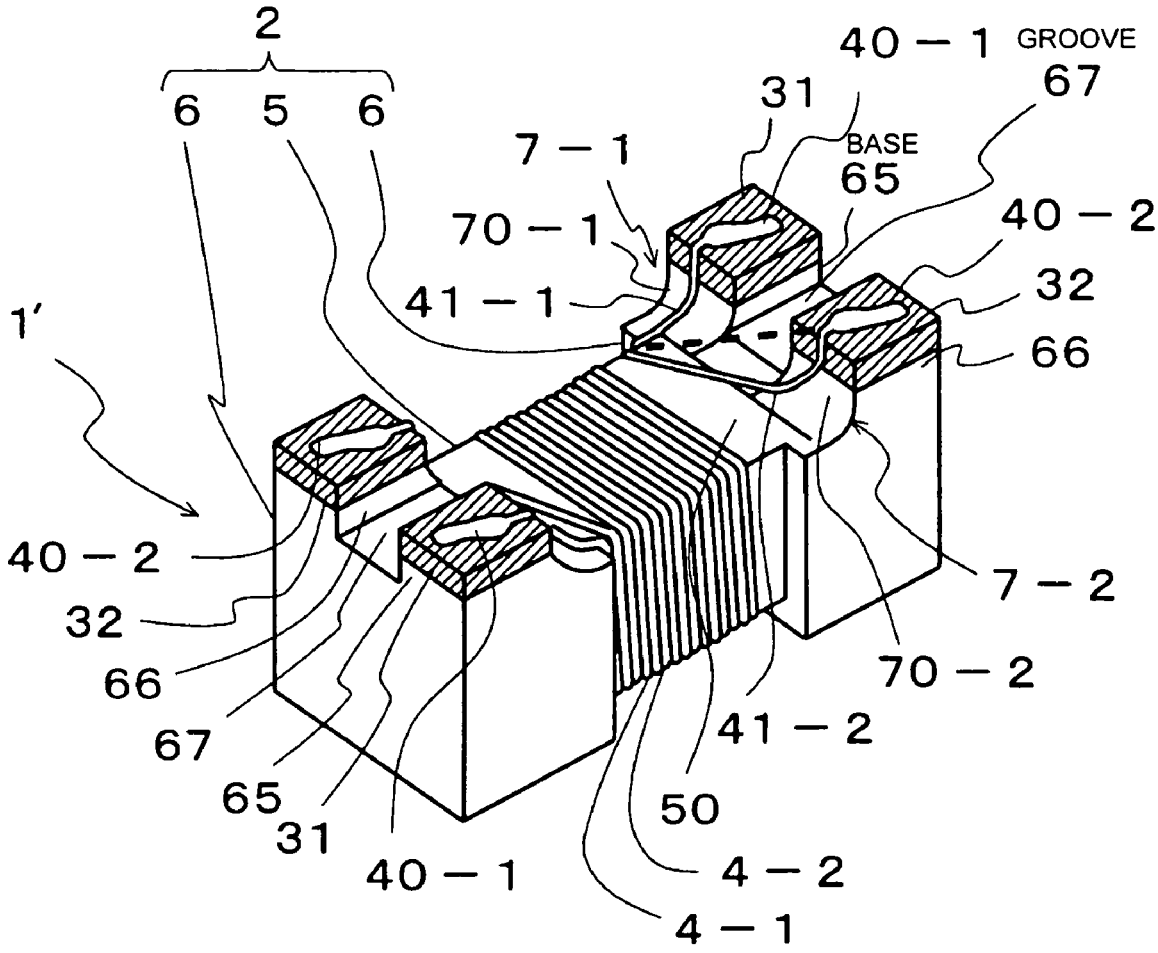
FIG. 11 is a perspective view of a wire-wound coil according to a second preferred embodiment of the present invention viewed from below.

FIG. 11 is a perspective view of a wire-wound coil according to a second preferred embodiment of the present invention viewed from below.

A wire-wound coil 1' according to this preferred embodiment is a wire-wound common mode choke coil including two wires.

As illustrated in FIG. 11, a core 2 of the wire-wound coil 1' includes a pair of flanges 6 provided at the axial ends of a winding core 5. Pairs of bases 65 and 66 are provided on the flanges 6.

The bases 65 and 66 are disposed substantially perpendicular to the axial direction of the winding core 5, in other words, disposed vertically with respect to a peripheral wall 50 of the winding core 5. Electrodes 31 and 32 are provided at the tips of bases 65 and 66, respectively.

The bases 65 and 66 have depressions 7-1 and 7-2, respectively. The depressions 7-1 and 7-2 include curved surfaces 70-1 and 70-2, respectively, which curve inwards in directions from the inner walls toward the outer walls of the bases 65 and 66. The curved surfaces 70-1 and 70-2 smoothly connect with the lower side of a peripheral wall 50 of the winding core 5 and form an arc that curves upwards from the border of the peripheral wall 50 toward electrodes 31 and 32.

A first wire 4-1 and a second wire 4-2 are alternately wound around the winding core 5. The tips 40-1 and 40-2 of the first and second wires 4-1 and 4-2 are bonded to the electrodes 31 and 32, respectively.

More specifically, the end portions 41-1 of the first wire 4-1 are disposed along the curved surfaces 70-1 of the depressions 7-1, and the tips 40-1 are bonded to the electrodes 31. The end portions 41-2 of the second wire 4-2 are disposed along the peripheral wall 50 of the winding core 5 to the curved surfaces 70-2 of the bases 66 and along the curved surfaces 70-2 to the electrodes 32. Then, finally, the tips 40-2 of the end portions 41-2 are bonded to the electrodes 32. In other words, the entire length of the end portions 41-1 and 41-2 is in contact with the core 2 and, thus, there are no substantial spaces between the end portions 41-1 and 41-2 and the core 2. In this manner, the end portions 41-2 are not disposed on grooves 67 between the bases 65 and 66 in a manner indicated by the dashed line in FIG. 11. In other words, the end portions 41-2 avoid the grooves 67.

Next, methods for manufacturing the wire-wound coil 1' according to this preferred embodiment will be described.

The methods to be described below are examples of the method for manufacturing a wire-wound coil according to the seventh to ninth preferred embodiments of the present invention.

Similar to the method according to the first preferred embodiment, the method according to this preferred embodiment also includes a core-forming step S1, an electrode-forming step S2, a winding step S3, and a wire-bonding step S4.

In the core-forming step S1 according to this preferred embodiment, the core 2 including the winding core 5, the pair of flanges 6, and the pairs of bases 65 and 66 is formed. At this time, the depressions 7-1 and 7-2 including the curved surfaces 70-1 and 70-2 are formed on each of the bases 65 and 66, respectively. Subsequently, the electrode-forming step S2 is carried out to form the electrodes 31 and 32 on the tips of the bases 65 and 66, respectively.

Then, the wire-winding step S3 is carried out to wind the first wire 4-1 and the second wire 4-2 around the winding core 5 while the core 2 is held steady. Subsequently, the wire-bonding step S4 is performed.

Figure 12:
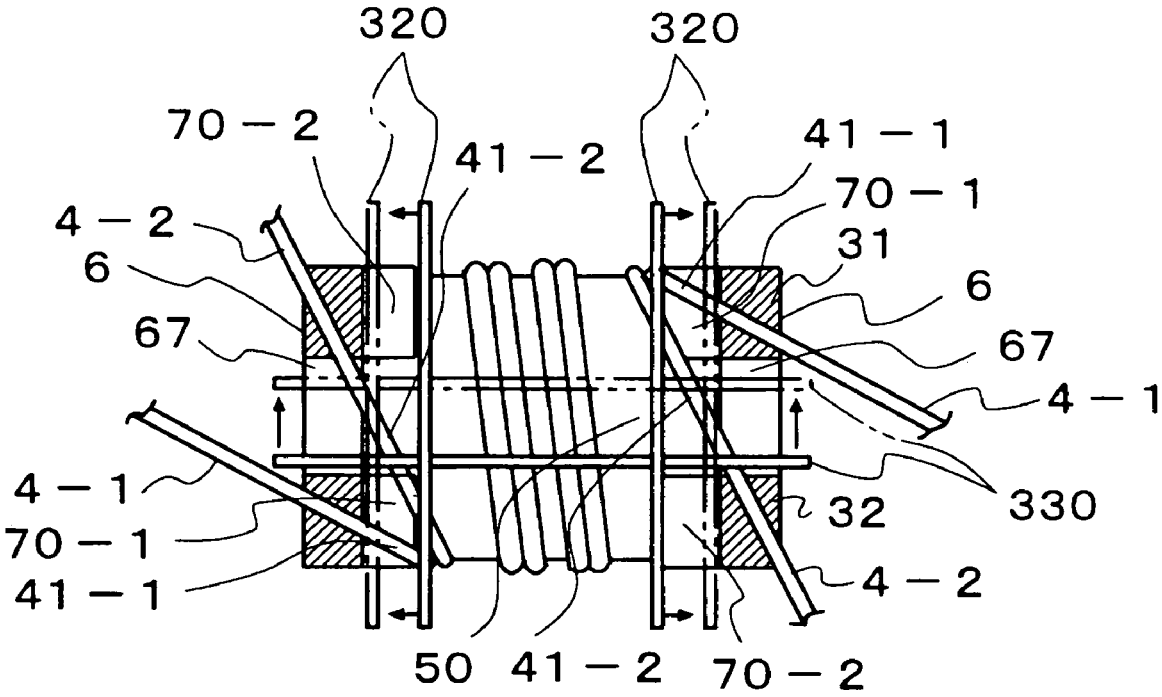
FIG. 12 is a plan view illustrating the process of the end portions of the wire, which is one of the steps of joining the wire.
Figure 13:
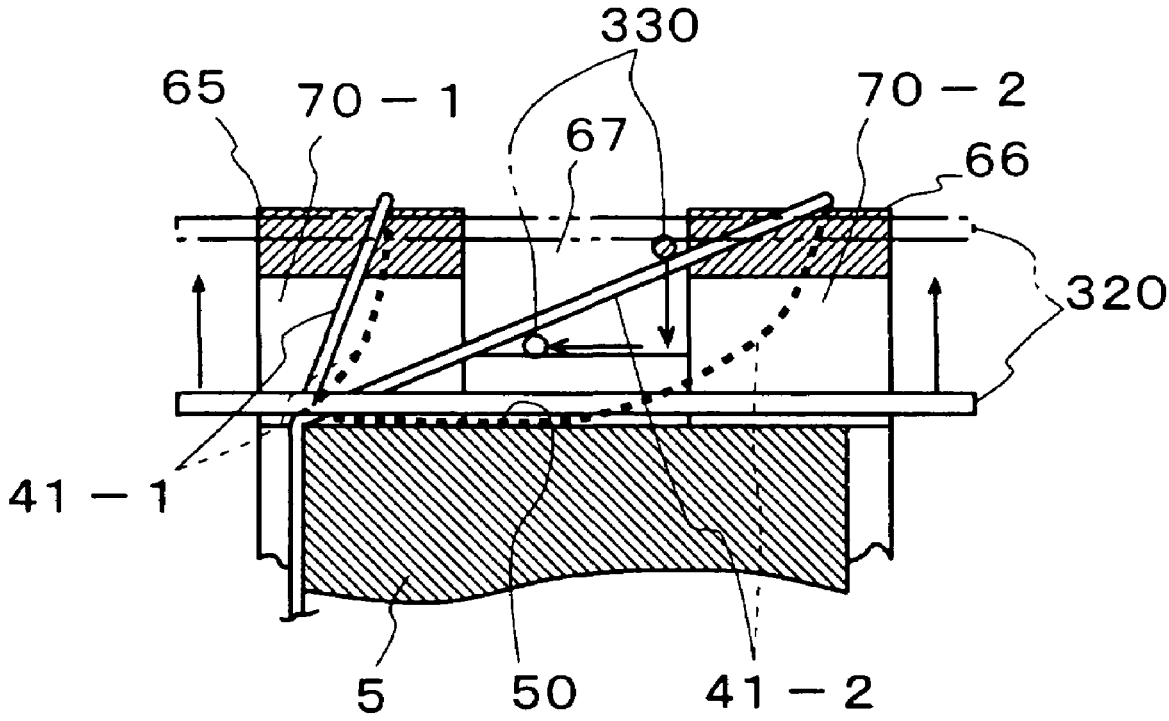
FIG. 13 is a front view illustrating the process of the end portions of the wire.

FIG. 12 is a plan view illustrating the process of the end portions 41-1 and 41-2, which is one of the processes in the wire-bonding step S4. FIG. 13 is a side view illustrating the process of the end portions 41-1 and 41-2.

The wire-bonding step S4 is a step for bonding the tips 40-1 of the first wire 4-1 with the electrodes 31 of the bases 65 and bonding the tips 40-2 of the second wire 4-2 with the electrodes 32 of the bases 66. Here, the first wire 4-1 and the second wire 4-2 have been wound around the winding core 5 in the wire-winding step S3.

More specifically, as illustrated in FIG. 12, the wire rods 320 are disposed horizontally across the curved surfaces 70-1 and 70-2 of the flanges 6. The wire rods 320 are disposed in contact with the first wire 4-1 and the second wire 4-2. This is similar to the process according to the first preferred embodiment. In this preferred embodiment, however, a step of moving the end portions 41-2 spanning the groove 67 away from the grooves 67 using a wire rod 330 is performed after the end portions 41-1 and 41-2 are processed.

More specifically, the wire rod 330 is passed through the grooves 67 and is disposed horizontally, as illustrated in FIG. 13. The wire rod 330 is in contact with the uppermost portion of the end portions 41-2. The end portions 41-2 are pressed down towards the winding core 5 with the wire rod 330. At this time, the wire rod 330 is moved downward in the direction indicated by the downward arrow in the drawing. Subsequently, the wire rod 330 is moved leftward in the width direction of the grooves 67 in the direction indicated by the leftward arrow in the drawing.

According to this preferred embodiment, the process with the wire rod 330 is performed after the process with the wire rods 320. However, the two different processes with the wire rods 320 and wire rod 330 may be performed simultaneously. Further, if the end portions 41-2 are also disposed along the curved surfaces 70-2 so as to avoid the grooves 67 by performing the process with the wire rods 320, the process with the wire rod 330 is not required, and thus, may be omitted.

As described above, since the end portions 41-1 and 41-2 of the first and second wires 4-1 and 4-2 of the wire-wound coil 1' according to this preferred embodiment are disposed along the curved surfaces 70-1 and 70-2, respectively, and also the end portions 41-2 are disposed along the peripheral wall 50, there is no space between the end portions 41-1 and 41-2 and the core 2. Consequently, the coating agent C neither enters nor accumulates between the end portions 41-1 and 41-2, and the curved surfaces 70-1, and 70-2, or between the end portions 41-1 and 41-2, and the peripheral wall 50. Moreover, since the end portions 41-1 and 41-2 are disposed along the curved surfaces 70-1 and 70-2, the end portions 41-1 and 41-2 are in an unstressed state. Therefore, similar to the wire-wound coil 1 according to the first preferred embodiment, the end portions 41-1 and 41-2 deform along with the contraction of the coating agent C without resistance, and thus, the first and second wires 4-1 and 4-2 do not break due to the coating agent C that has entered and accumulated between the end portions 41-1 and 41-2 and the core 2. Furthermore, no tension is generated at the end portions 41-1 and 41-2, and the end portions 41-1 and 41-2 do not bear a load. Consequently, the coating agent C does not break the end portions 41-1 and 41-2. Since the end portions 41-2 are disposed such that they are not in contact with the grooves 67, even if the coating agent C accumulates in the grooves 67, the accumulated coating agent C does not come into contact with the end portions 41-2. As a result, the end portions 41-2 do not break due to the contraction of the coating agent C.

Since other structures, operations, and advantages of the wire-wound coil 1' according to this preferred embodiment are the same as those of the first preferred embodiment, descriptions thereof are omitted.

The present invention is not limited to the preferred embodiments described above, and variations and various changes are allowed within the scope of the present invention.

Figure 14:
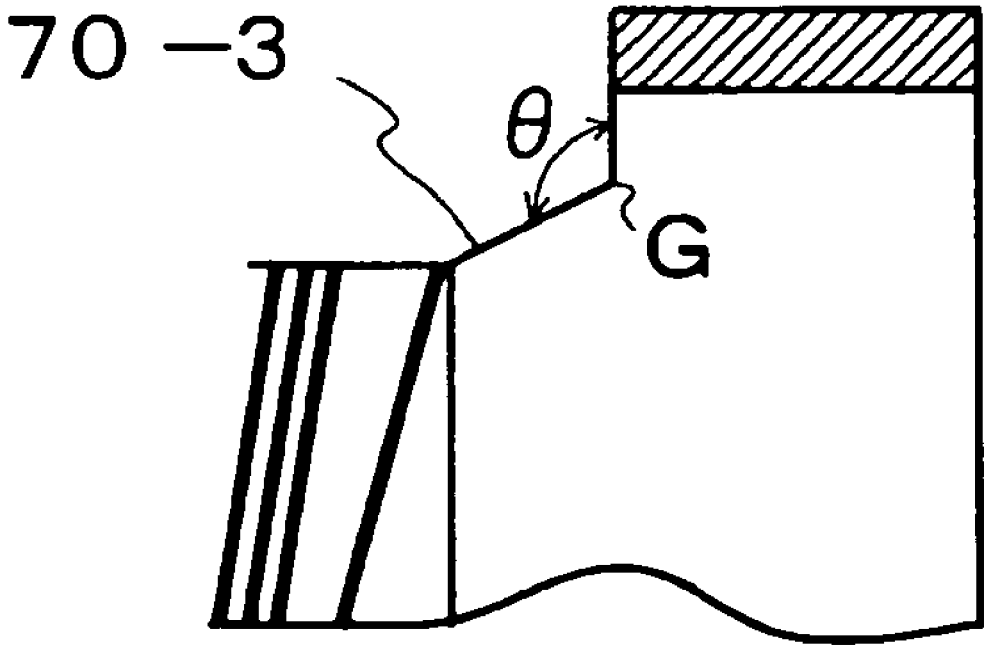
FIG. 14 is a partial side view of a variation of a curved surface.
Figure 15:
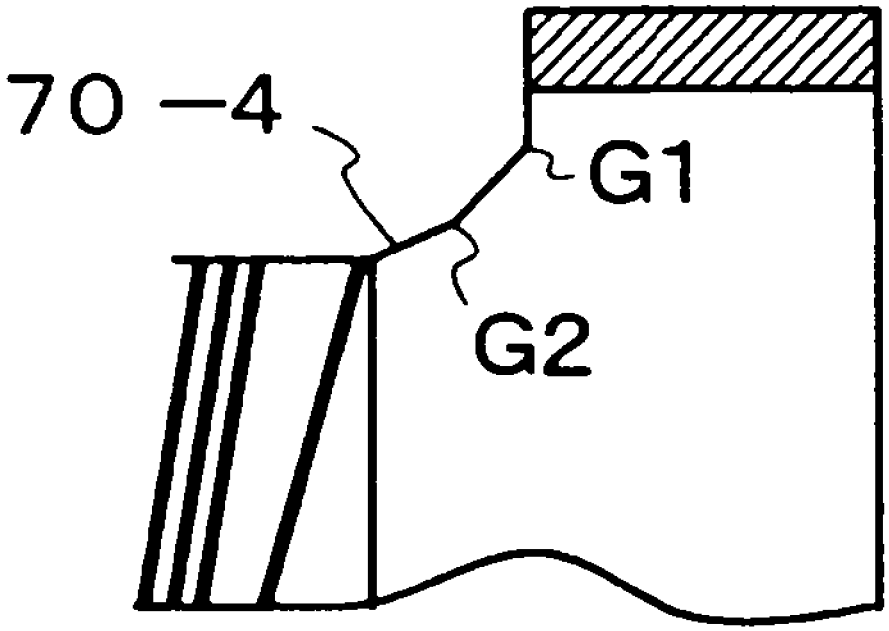
FIG. 15 is a partial side view of another variation of the curved surface.
Figure 16:
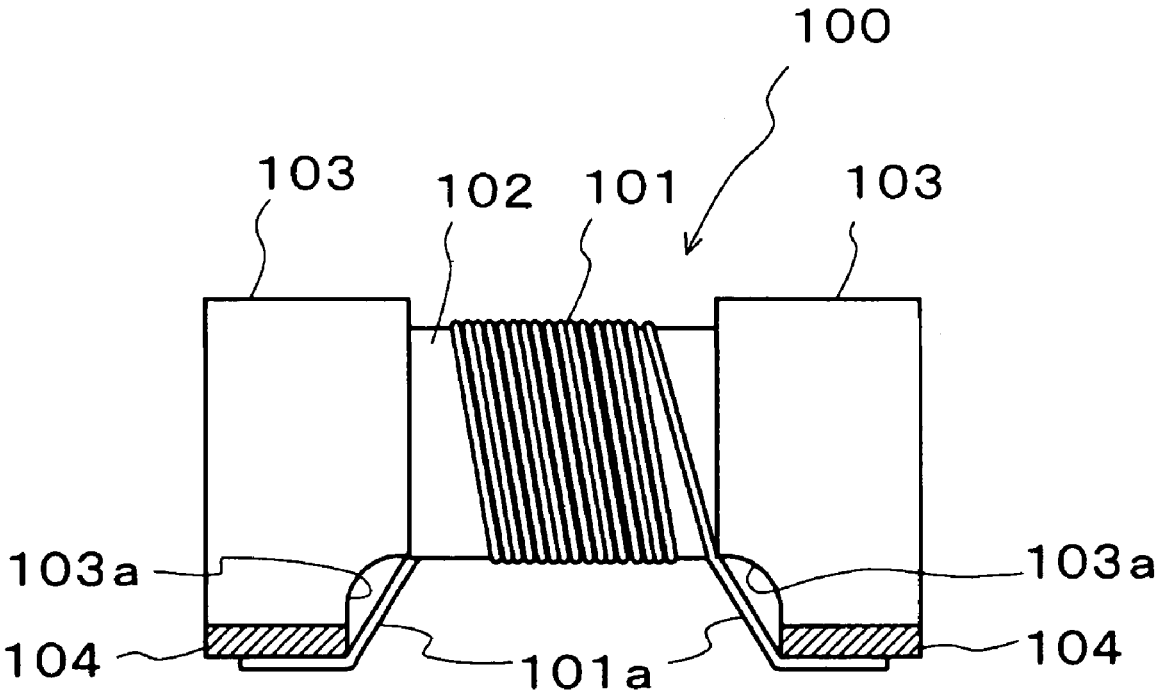
FIG. 16 PRIOR ART
FIG. 16 is a perspective view of a known wire-wound coil.
Figure 17A:
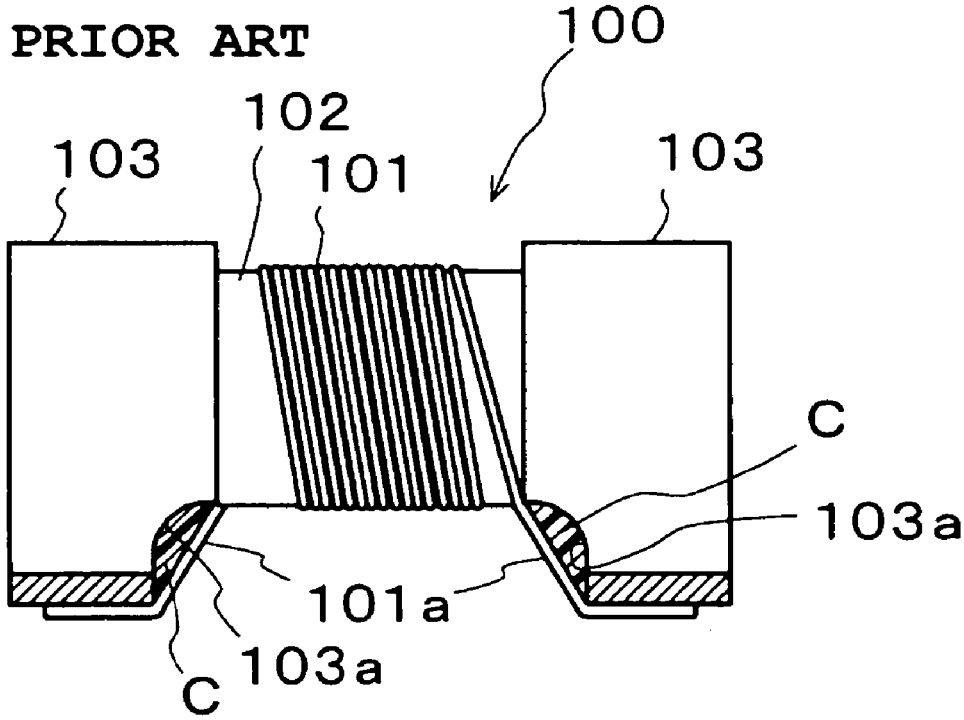
FIG. 17A PRIOR ART
FIGS. 17A and 17B are side views illustrating a wire-wound coil in which a coating agent has entered and accumulated in the area around rounded corners R.
Figure 17B:
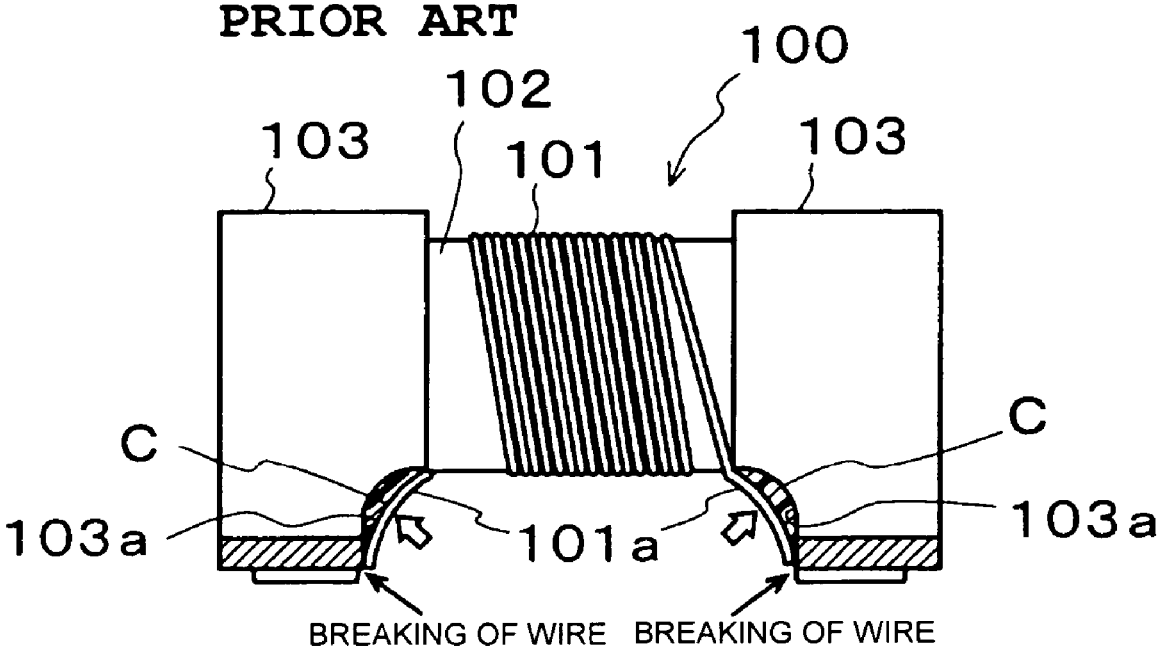
FIG. 17B PRIOR ART
Figure 18:
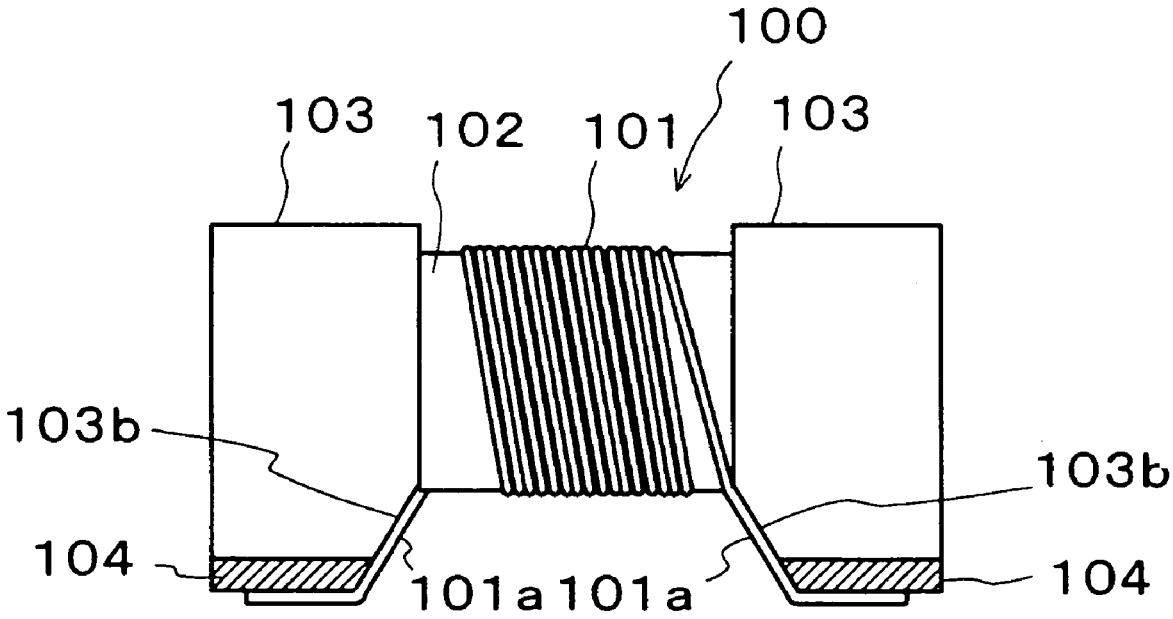
FIG. 18 PRIOR ART
FIG. 18 is a side view of a known wire-wound coil having a structure for preventing the breaking of wire.
Figure 19A:
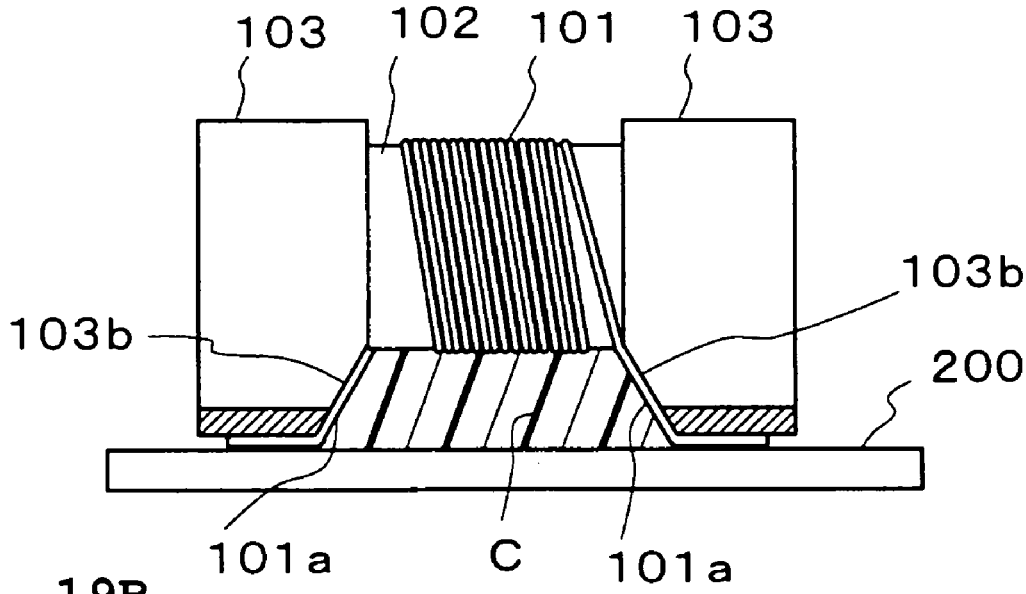
FIG. 19A PRIOR ART
FIGS. 19A and 19B are side views illustrating a wire-wound coil in which a coating agent has entered and accumulated between the wire-wound coil and a substrate.
Figure 19B:
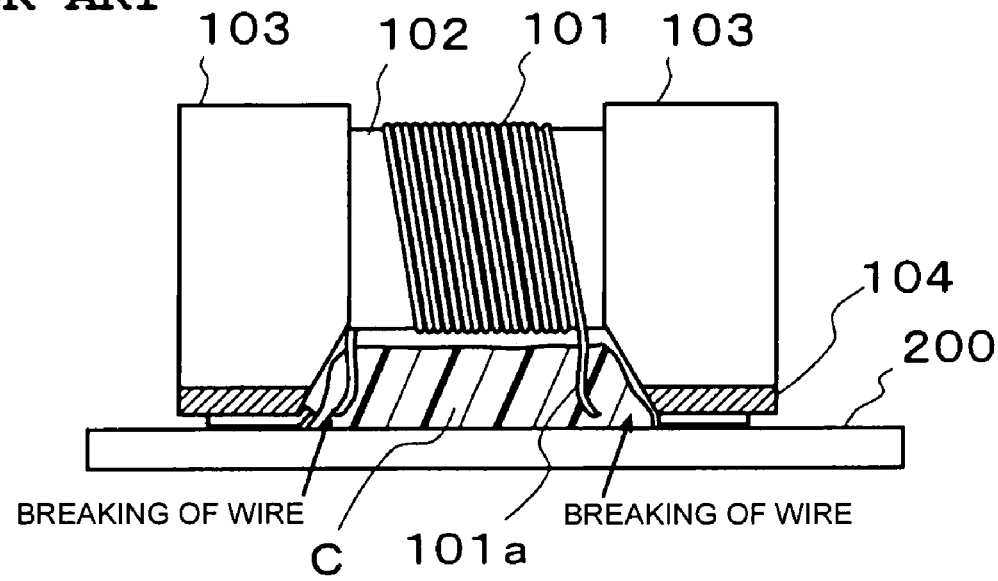
FIG. 19B PRIOR ART
Figure 20:
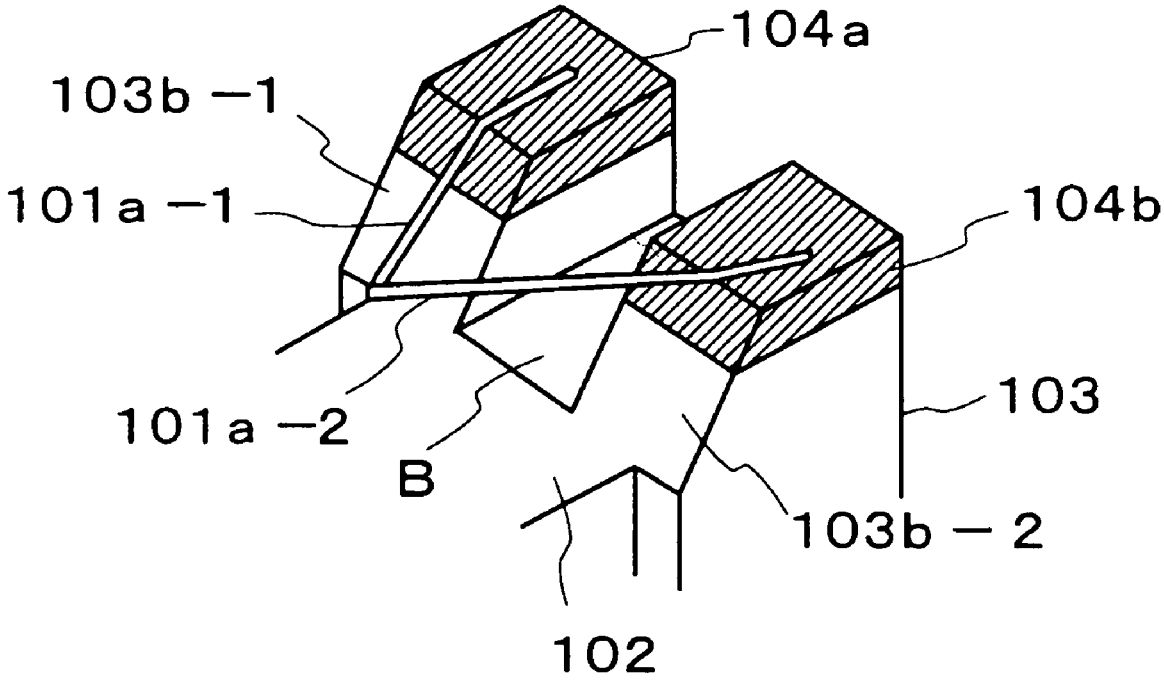
FIG. 20 PRIOR ART
FIG. 20 is an enlarged partial view of a pair of bases and a groove.

In the above-described preferred embodiments, curved surfaces 70, 70-1, and 70-2 having substantially arc-shaped cross-sections were described. However, the shape of the cross-section is not limited to an arc, and may be a polygonal cross-section such as a curved surface 70-3 illustrated in FIG. 14. The surfaces of the curved surface 70-3 come into contact at a point G at an angle θ that is preferably more than 90 degrees. As illustrated in FIG. 15, a curved surface 70-4 having a plurality of points G1 and G2 may also be used.

While the present invention has been described with respect to preferred embodiments, it will be apparent to those skilled in the art that the disclosed invention may be modified in numerous ways and may assume many embodiments other than those specifically set out and described above. Accordingly, it is intended by the appended claims to cover all modifications of the invention that fall within the true spirit and scope of the invention.

What is claimed is:

1. A wire-wound coil comprising:

a core including a winding core and a pair of flanges provided at axial ends of the winding core;

electrodes provided on peripheral walls of the flanges; and a wire wound around the winding core, the wire having end portions that extend to and are bonded to the electrodes; wherein curved surfaces curving inward in directions from inner walls to outer walls of the flanges smoothly connect with a peripheral wall of the winding core so as to define depressions on the flanges; and the end portions of the wire are disposed along the curved surfaces of the depressions and tips of the end portions of the wire are bonded to the electrodes.

2. The wire-wound coil according to claim 1, wherein the cross-section of each of the curved surfaces of the depressions is substantially arc-shaped.

3. The wire-wound coil according to claim 1, wherein said winding core is substantially prism-shaped.

4. The wire-wound coil according to claim 1, wherein the electrodes are composed of plating layer made of Ni, Sn, or Sn—Pb and a film of made of Ag, Ag—Pd or Ag—Pt disposed on the plating layer.

5. The wire-wound coil according to claim 4, wherein the plating layer has a thickness in the range of about 1 μm to about 30 μm, and the film has a thickness in the range of about 10 μm to about 30 μm.

* * * * *